US005184675A

United States Patent [19]

Gardner

[11] Patent Number: 5,184,675

[45] Date of Patent: Feb. 9, 1993

[54] THERMAL ENERGY TRANSFER APPARATUS AND METHOD OF MAKING SAME

[76] Inventor: Ernest A. Gardner, 142-1/2 Canal Ave., NW, Canal Fulton, Ohio 44614

[21] Appl. No.: 775,349

[22] Filed: Oct. 15, 1991

[51] Int. Cl.[5] ..... F28F 1/36

[52] U.S. Cl. ..... 165/184; 165/181; 165/907

[58] Field of Search ..... 165/109.1, 133, 181, 165/184, 907

[56] References Cited

U.S. PATENT DOCUMENTS

| | | | |
|---|---|---|---|
| 927,702 | 7/1909 | Zent | 165/184 |
| 2,448,315 | 8/1948 | Kunzog | 165/907 X |
| 2,615,686 | 10/1952 | Davidson | 165/184 X |
| 3,095,255 | 6/1963 | Smith | 165/907 X |
| 3,825,064 | 7/1974 | Inoue | 165/179 |
| 4,074,753 | 2/1978 | Schmittle et al. | 165/184 |
| 4,246,057 | 1/1981 | Janowski et al. | 156/50 |
| 4,253,519 | 3/1981 | Kun et al. | 165/110 |
| 4,428,403 | 1/1984 | Lee et al. | 138/130 |
| 4,448,043 | 5/1984 | Aragou | 62/515 |
| 4,981,172 | 1/1991 | Haerle | 165/133 |

FOREIGN PATENT DOCUMENTS

| | | | |
|---|---|---|---|
| 100563 | 7/1897 | Fed. Rep. of Germany | 165/179 |
| 56-155394 | 12/1981 | Japan | 165/133 |
| 57-150800 | 9/1982 | Japan | 165/184 |
| 984156 | 2/1965 | United Kingdom | 165/109.1 |

*Primary Examiner*—Allen J. Flanigan
*Attorney, Agent, or Firm*—Paul E. Milliken; Lee A. Germain

[57] ABSTRACT

A thermal energy transfer apparatus and a method of making such apparatus by helically wrapping multiple layers of spaced apart thermally conductive wires on a fluid conducting pipe to provide an open mesh-like configuration with exposed surface areas to transfer heat or cold to the surrounding atmosphere from fluid passed through the pipe. The wire is secured by welding or other suitable means to prevent it from becoming unwrapped. The mesh-like configuration can also be made by concentrically wrapping thermally conductive screen around the pipe and securing it in the wrapped configuration.

19 Claims, 4 Drawing Sheets

THERMAL ENERGY TRANSFER APPARATUS AND METHOD OF MAKING SAME

TECHNICAL FIELD

This invention relates to a thermal energy transfer apparatus and to a method for manufacturing such apparatus by wrapping strands of thermally conductive material around a fluid conducting member in such patterns as to provide increased exposed surface areas for thermal transfer between the fluid conducting member and the surrounding atmosphere.

BACKGROUND OF THE INVENTION

Various types of heat exchangers or thermal energy transfer devices have been used in the past to provide heating or cooling air within rooms, in automotive vehicles and other applications.

One of the typical thermal energy transfer devices which have been used in a room heating convector apparatus includes, a pipe through with hot water flows, plural fins on the pipe, and a blower for blowing air across the pipe and fins so that the air is heated during such passage. Cooling fluid could also be circulated through the pipe in order to provide cooling to the room.

In such a device the fins are welded or otherwise secured to the outside surface of the pipe. The connections of the fins to the outside surfaces of the pipeline frequently impede the conduction of heat between the pipeline material and the major portion of the fin material. Additional disadvantages of the fin type heat exchanger are the cost of manufacture and the large size of the devices which make them impractical in applications where space is limited.

U.S. Pat. No. 4,369,835 (P. R. Goudy, Jr.) shows a fin arrangement combined with an internal mesh screen arrangement for increasing the conduction of thermal energy from water flowing through the screen.

The use of hollow tubular heat transfer coils sandwiched between layers of expanded metal foil screen is shown is U.S. Pat. No. 4,540,045 (V. D. Molitor). The screen provides heat transfer between water flowing through the heat transfer coils and a fluid such as air passed through the mesh screen.

Other examples of the use of mesh screen to aid heat transfer in a laminated panel are shown in U.S. Pat. Nos. 4,403,653 (Davidson) and 4,483,325 (Siemiller).

The prior art devices have bulky, complicated and expensive to produce.

OBJECTS OF THE INVENTION

It is a primary object of this invention to provide a thermal energy transfer device which is compact, simple to manufacture and install and less expensive than conventional thermal energy devices.

Another object of this invention is to provide a thermal energy transfer device which has an increased exposed surface area for thermal energy transfer in relationship to the overall size of the device.

Still another object of the invention is to provide a thermal energy transfer device which is more durable than the fin type device and less likely to be bent or damaged during handling or installation.

A still further object of this invention is to provide a thermal energy transfer device which is versatile and can be easily tailored to any energy transfer capacity requirements of any particular installation.

These and other objects of the invention will become more fully apparent in the following specification and the attached drawings.

SUMMARY OF THE INVENTION

This is a thermal energy transfer device made by providing a hollow elongated fluid conducting member having an inlet end, an outlet end and an outer surface surrounding the member, wrapping the fluid conducting member with a plurality of layers of spaced apart strands of thermally conductive material, with the strands of the first layer wrapped in intimate contact with the outer surface of the fluid conducting member and the strands of each successive layer being in intimate contact with the strands of the previous layer on which they are wrapped, and securing the wrapped layers of strands in such manner as to prevent them becoming unwrapped.

DESCRIPTION OF THE PREFERRED EMBODIMENTS

Figure 9:
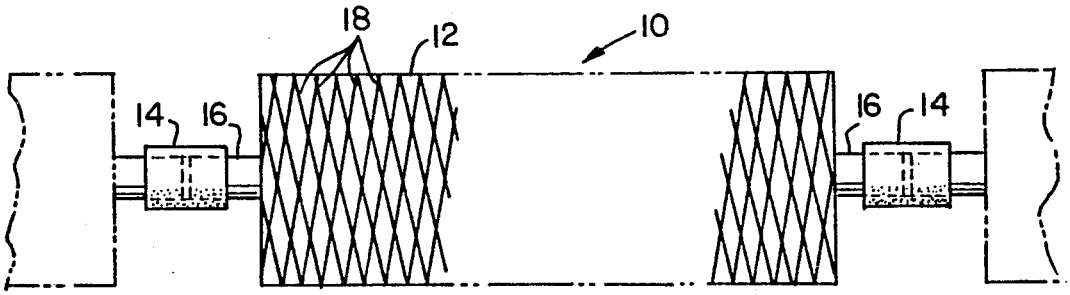
FIG. 9 is a front elevational view showing a series of thermal energy transfer units joined together end to end.

Referring now to the drawings and in particular to FIG. 9, a thermal energy transfer system indicated generally by the numeral 10 is comprised of a series of thermal energy transfer units 12 joined together in end to end relationship by end couplings 14 which sealingly couple the adjacent ends of fluid conducting pipes 16 upon which are wrapped a plurality of layers of thermal conductive wire strands 18. The strands 18 may be of any thermal transfer material but are preferably metal wire such as copper or aluminum. The fluid conducting pipe 16 is also made of thermally conductive material and could also be copper, aluminum or other suitable thermal conductive material.

Figure 1:
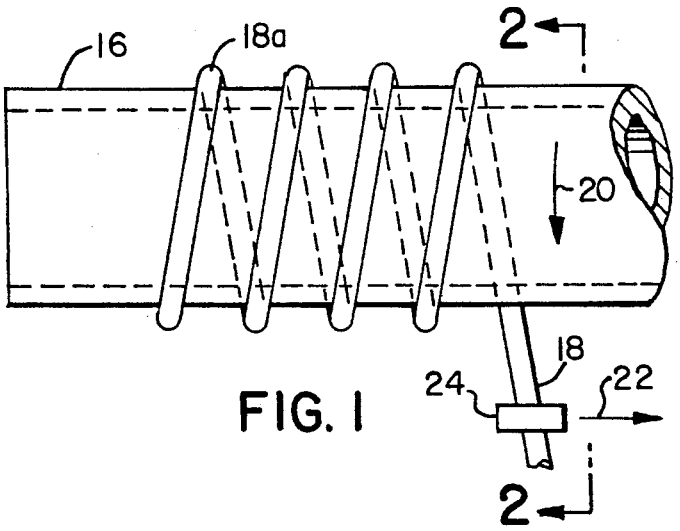
FIG. 1 is a fragmentary front elevational view showing a first layer of a thermal conductive strand being wrapped on a fluid conducting pipe.
Figure 2:
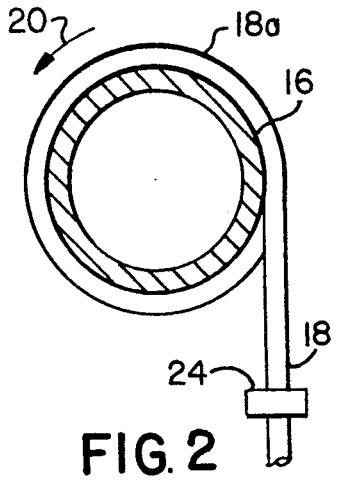
FIG. 2 is a cross-sectional view taken on line 2—2 of FIG. 1.

FIGS. 1 and 2 show a first layer 18a of strands of thermal conductive wire 18 being wrapped in a helical pattern in intimate contact with the outer surface of the fluid pipe 16 by rotating the pipe in the direction of the arrow 20 while moving the wire 18 longitudinally of the pipe 16 in the direction of the arrow 22 by a guide 24. The spacing between the wraps of wire 18, the gage of the wire, and the number of layers of wire can be varied depending upon the thermal energy transfer requirements of each situation.

A preferred wire gage for many applications is #16 wrapped at 20 turns per inch, (8 turns per cm). A typical size of pipe used may have an I.D. of ½", (1.27 cm), although other sizes may also be used. In many applications 14 layers of wire may provide the necessary surface area for thermal transfer, however this will depend upon other factors such as the wire size, the spacing of the wraps and the overall heat transfer requirements.

Figure 3:
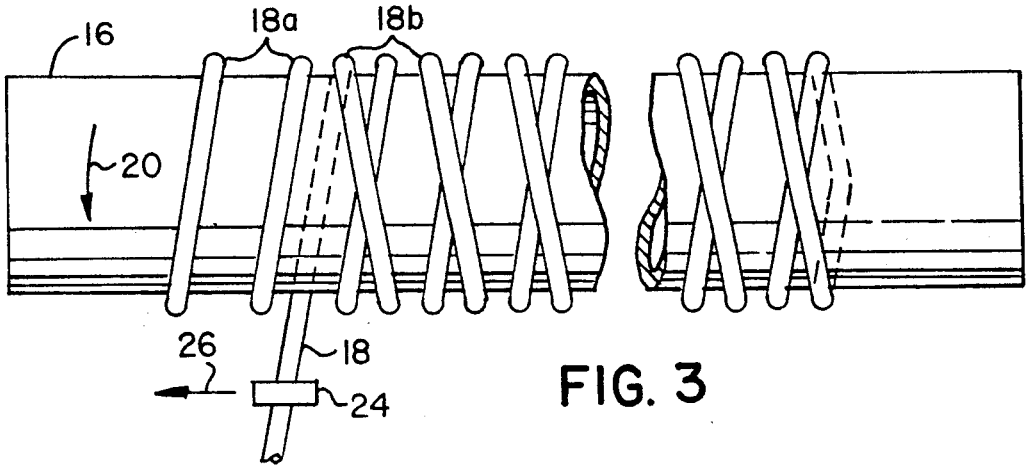
FIG. 3 is a front elevational view similar to FIG. 1 but showing the second layer of thermal conductive strand being wrapped on the fluid conducting pipe.

FIG. 3 shows a second layer 18*b* of wire 18 being wrapped on the pipe 16 by rotating the pipe in the direction of the arrow 20 but moving the wire 18 longitudinally in the direction of the arrow 26 by the guide 24. The helical wraps of the second layer 18*b* are inclined at an opposite angle to the wraps of the first layer 18*a* and the wires 18 of the second layer 18*b* cross over the wires of the first layer 18*a* as may be seen in FIG. 3 and are in intimate contact with the wires of the first layer 18*a* at the points of cross-over.

Figure 4:
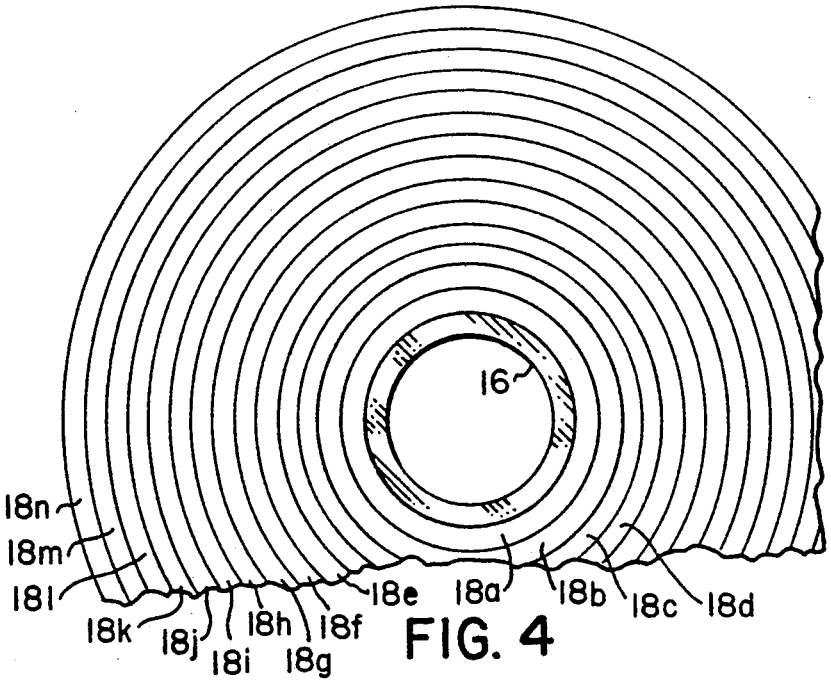
FIG. 4 is a fragmentary diagrammatic end view showing how successive layers of the thermal conductive strands are wrapped in a stacked pattern on the fluid conducting pipe until the desired diameter is reached.
Figure 5:
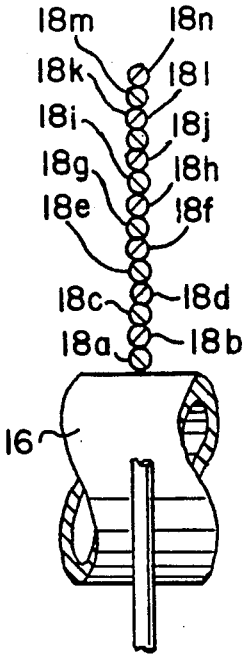
FIG. 5 is a fragmentary view taken at 90° to the view shown in FIG. 4, with portions broken away to show a typical example of how thermal conductive strands wrapped on a pipe form a configuration similar to a thermal conductive fin.

In FIGS. 4 and 5 wire layers 18*a* through 18*n* are shown wrapped on the pipe 16 however, any desired number of layers may be wrapped on the pipe 16. In order to achieve the configuration shown in FIGS. 4 and 5, the spacing between the wraps of wire must be the same in each layer. When the wires 18 of each layer are positioned directly on top of the wire of the previous layer, the configuration formed is that of a radially outwardly extending fin except that due to the curved surfaces of the wire, more surface area is exposed than would be exposed by a flat fin of the same outside diameter. The additional surface area provided by the wires may be more easily seen in the enlarged view in FIG. 12.

In operation of the device, hot or cold fluid is passed through the pipe 16. In a typical heating mode hot water is passed though the pipe 16 and the heat from the water passes outwardly through a wall of the pipe and then through the layers of wrapped wire 18 to the surrounding atmosphere. The layers of wrapped wire 18 because of their round shape, present a greater surface area than would be provided by flat fins of the same outside diameter. The arrangement of wrapped wires therefore, provides greater heat transfer efficiency for the same size of thermal transfer unit.

Figure 6:
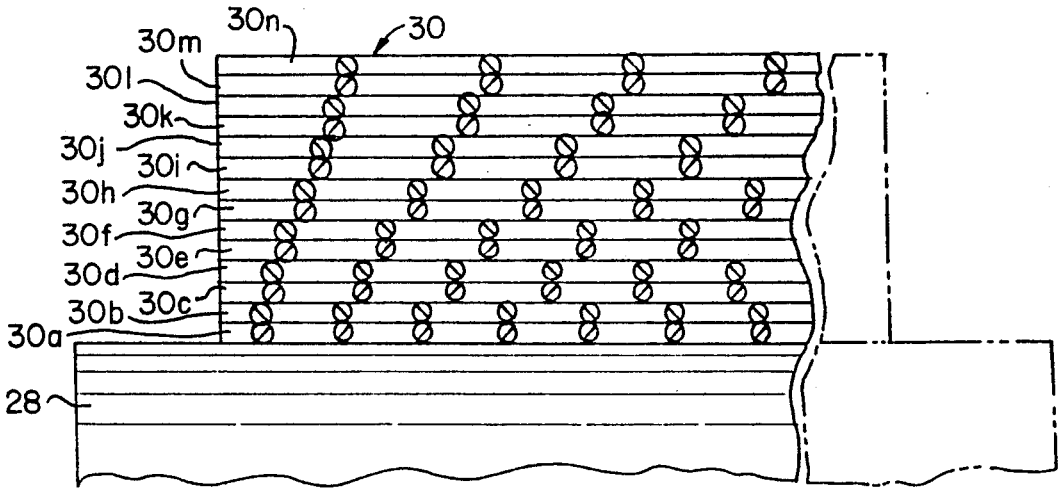
FIG. 6 is a diagrammatic view showing how layers of thermal conductive strands are wrapped on a fluid conducting pipe with the spacing between the strands differing from one layer to another.

In some applications it may be preferable to vary the spacing between the wraps of the wires 18 so that the wraps are closer together in the innermost layers and are spaced progressively farther apart toward the outermost layers. An example of this configuration is shown in FIG. 6 in which a pipe 28 has a plurality of layers 30 of wire wraps 30*a* through 30*n*. In this configuration, it may be seen that the first two layers 30*a* and 30*b* have the same spacing between the wraps ie. the same number of wraps per inch. In each successive pair of layers, the spacing between the wires is progressively increased by applying fewer wraps per inch. This provides a wrapped wire pattern which is more open in the outer layers to provide better air circulation throughout the various layers and better overall thermal energy transfer. In some instances, rather than progressively increasing the spacing between the wires, it may be desirable to alter the spacing between the wires in a different sequence such as alternating between closer and wider spacing.

Figure 7:
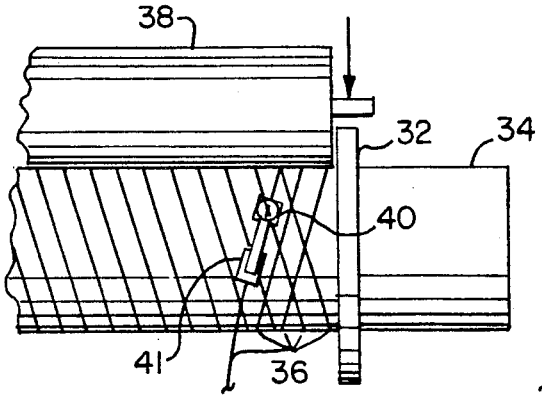
FIG. 7 is a fragmentary front elevational view of a fluid conducting pipe being wrapped with thermally conductive strands and a mechanism for welding together the strands.
Figure 8:
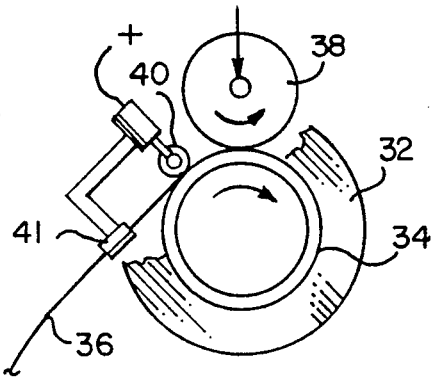
FIG. 8 is an end view of the apparatus shown in FIG. 7.

In wrapping the wires on a fluid transfer pipe it may be desirable in some applications to provide, near each end of the pipe, an end retainer member such as the retainer 32 shown in FIGS. 7 and 8. The retainer 32 is a ring like member temporarily attached by any suitable means on each end of a pipe 34 to retain wires 38 from moving longitudinally outwardly past the retainer 32 while the wires 36 are being wound on the pipe 34.

A pressure roller 38 bears against the wire 36 after it has been wrapped on the pipe 34 and stabilizes it for welding by a welding wheel 40 carried by a wire feed guide 41 which is moved longitudinally of the pipe 34 as it is being rotated. The guide 41 may be moved by a conventional feedscrew (not shown) or by other suitable means. The welding wheel 40 senses each intersection of the wires 36 and applies a burst of current through the intersection thereby welding the wires 36 together at the intersection.

Figure 10:
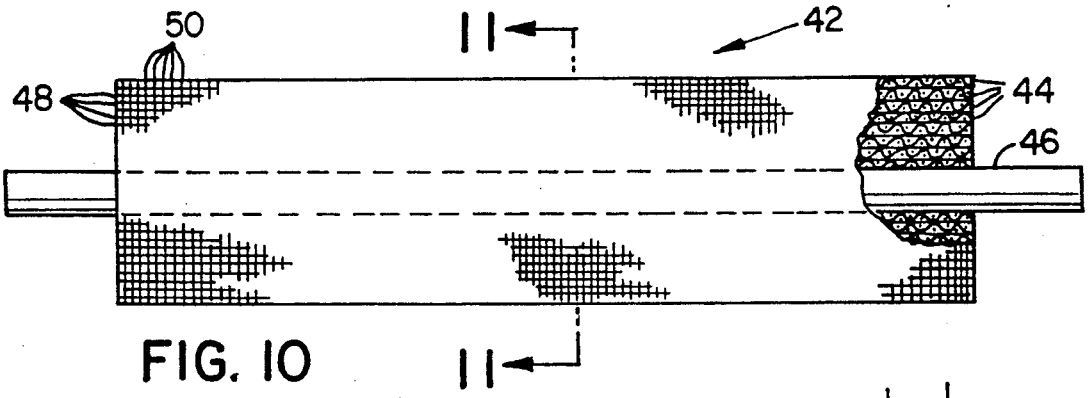
FIG. 10 is a front elevational view of another embodiment of the invention.
Figure 11:
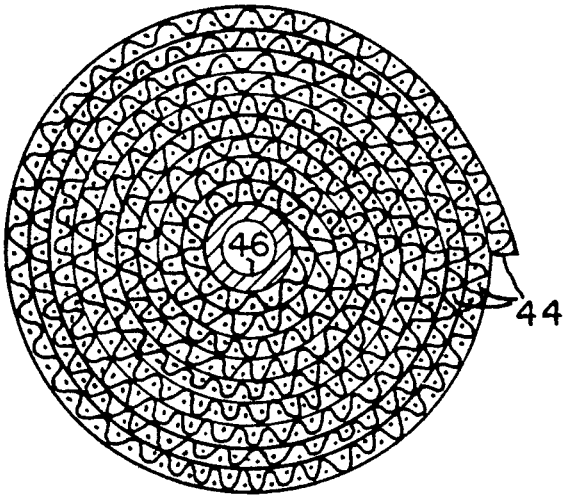
FIG. 11 is a cross-sectional view taken on line 11—11 of FIG. 10.

A different embodiment of the invention is shown in FIGS. 10 and 11 in which a thermal energy transfer unit is indicated generally by the numeral 42 comprised of a plurality of layers of thermally conductive screen 44 wrapped circumferentially around a pipe 46 and suitably fastened by welding, tying or other means so that the layers will not become unwrapped. The screen 44, has a first set of the wires 48 extending longitudinally of the pipe 46 and a second set of the wires 50 extend circumferentially of the pipe 46 when the screen is wrapped thereon. In other applications the wires may also lie in other relative orientations with respect to the longitudinal axis of the pipe 46. As the multiple layers are wrapped, the circumferential wires 50 may become stacked on top of each other as shown in FIGS. 4 and 5 or in FIG. 12.

Figure 12:
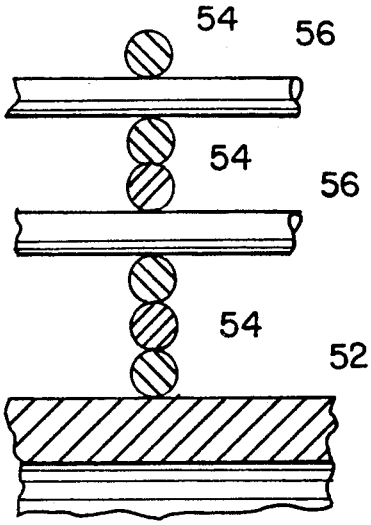
FIG. 12 is a greatly enlarged fragmentary view showing details of intersecting layers of thermal conductive strands.

FIG. 12 does not relate specifically to any other figure of the drawings but is for the purpose of illustrating some of the stacking and cross-over patterns which may occur either with the helically wrapped wires in FIGS. 1 through 3 or with the wires of the circumferentially wrapped screen 44 in FIGS. 10 and 11. In FIG. 12 a fragmentary view shows a pipe 52 having a plurality of wires 54 in a stacked orientation and parallel to each other and a plurality of wires 56 lying between part of the wires 54 and crossing over the wires 54 at some unspecified angle which would depend upon the angle of wrap on the pipe 52 and upon whether a helical wrap is used or a screen such as that shown in FIGS. 10 and 11 is used. As previously mentioned FIG. 12 emphasizes the additional exposed thermal transfer surfaces that are provided by the rounded circumferences of the wires as compared to the flat surfaces of conventional heat transfer fins. In operation, when hot water for example, is circulated through the pipe 52 the heat transfers outwardly from the pipe into the wires 54 and travels both longitudinally and circumferentially through the wires 54 and 56 and then into the surrounding atmosphere. If air is circulated across the wires 54 and 56, this increases the heat transfer into the surrounding atmosphere.

Figure 13:
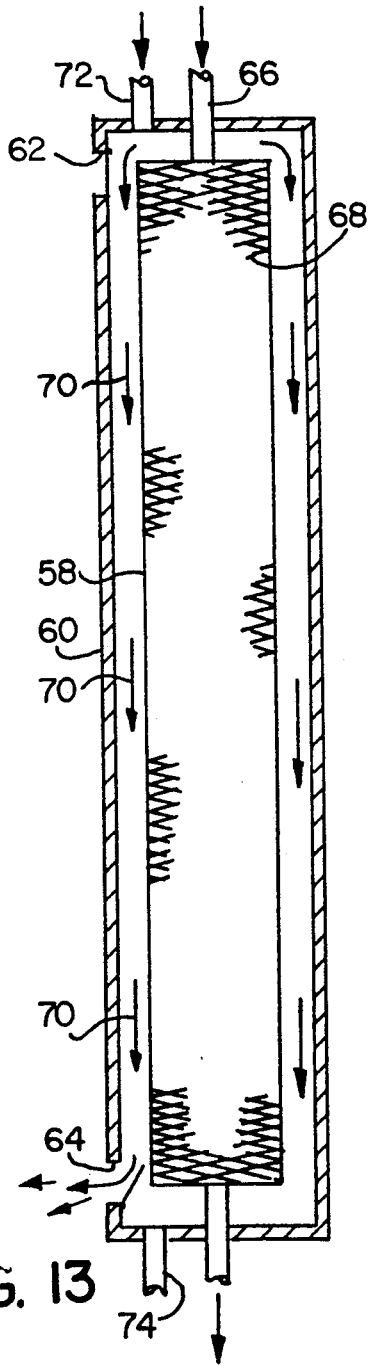
FIG. 13 is a cross-sectional view showing a thermal transfer duct using the thermal transfer apparatus of this invention.

FIG. 13 shows an example of a way in which a thermal transfer unit of this invention may be used in a room heating and/or cooling application. A heat transfer unit 58 which could be of the same construction as any of those previously shown herein is positioned inside a heating and cooling duct 60 having a top cooling outlet 62 and a bottom heating outlet 64. As shown, water is circulated downwardly through a pipe 66 and the heat is transferred radially outwardly through the layers of wrapped wire 68 and is carried downwardly by a flow of air indicated by the arrows 70 which is induced by air injected into the duct 60 through the air pipe 72 at the top of the duct 60. With the top cooling outlet 62 closed the air coming into the top of the duct 60 carries the heat from the unit 68 downwardly and out of the bottom heating outlet 64 to heat the surrounding air in a room. In the cooling mode the process is reversed and cool water or other fluid is passed through the pipe 66. The top cooling outlet 62 is opened and the bottom heating outlet 64 is closed. Air is then injected into the bottom of the duct 60 through a bottom pipe 74 and the air flows upward in the duct 60 as the air is cooled by the unit 68. The cool air is then forced out of the cooling outlet 62 at the top of the duct.

Figure 14:
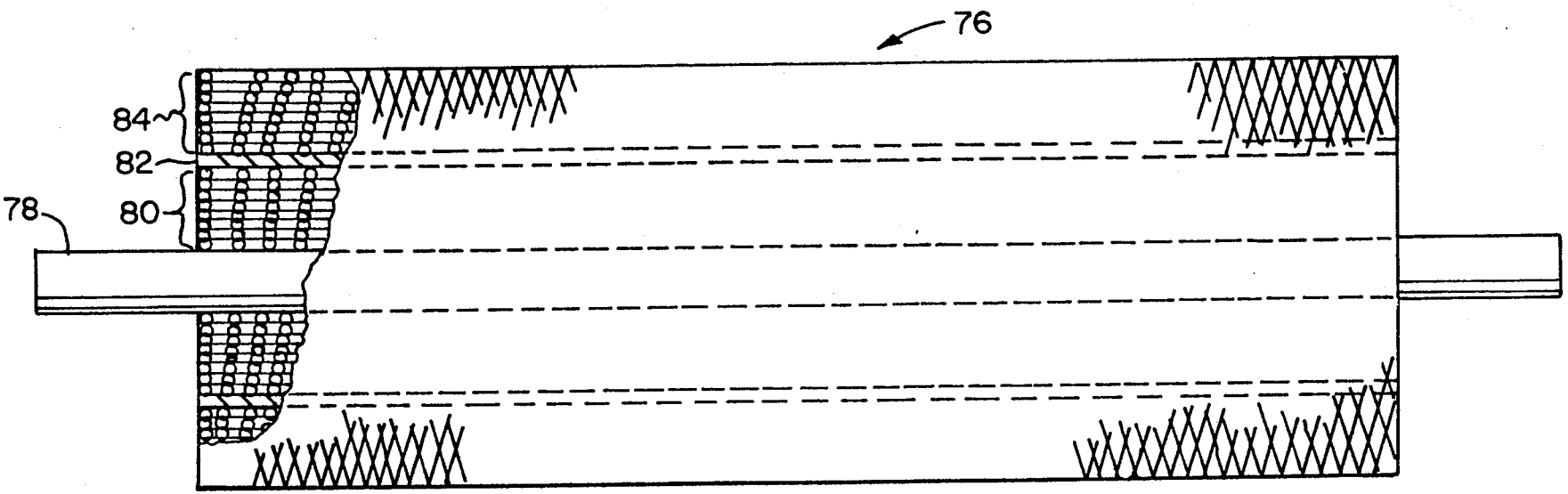
FIG. 14 is ~ front elevational view of another embodiment of the invention with portions broken away to show the configuration of the layers of wrapped thermal conductive strands.
Figure 15:
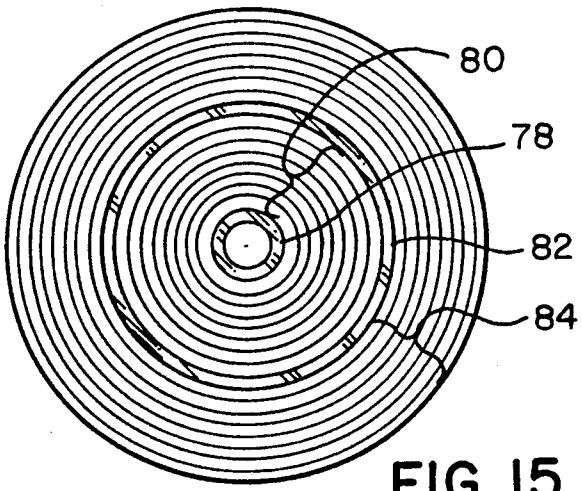
FIG. 15 is an end view of the embodiment shown in FIG. 14.

Another embodiment of the invention is shown in FIGS. 14 and 15 wherein a thermal transfer unit is indicated generally by the numeral 76. The unit has a first pipe 78, an inner group of layers of helically wrapped wire 80, a second pipe 82 surrounding the wire layers 80, and an outer group of layers of helically wrapped wire 84 surrounding the second pipe 82. While the present embodiment uses two concentric pipes with multiple wraps of wire on the outside of each pipe a larger number of such concentric pipes can be used if needed for certain applications.

It should also be mentioned that air or other fluid can be passed in one longitudinal direction through the inner group 80 of wire layers and can be passed in the same or opposite longitudinal direction through the outer group 84 of wire layers if the group 80 is surrounded by a pipe similar to the pipe 82. It should be also understood that the embodiment shown in FIGS. 14 and 15, instead of using helically wrapped wire, can also use concentrically wrapped screen such as that shown in FIGS. 10 and 11 to form the groups 80 and 84 of wire layers.

The welding techniques shown in FIGS. 7 and 8 are equally applicable when screen is used. It should also be recognized that the welding of the wires can also be accomplished by other means.

These and various other modifications can be made in the embodiments shown herein without departing from the scope of the invention.

I claim:

1. A thermal energy transfer apparatus comprising:

(A) a hollow elongated fluid conducting member having:
  (1) an inlet end,
  (2) an outlet end, and
  (3) an outer surface surrounding the member, (B) thermal energy transfer means, surrounding at least a substantial portion of the outer surface of the fluid conducting member, for transferring thermal energy with respect to the fluid conducting member comprising;
  (1) at least three layers of spaced apart thermally conductive metal strands surrounding the fluid conducting member,
  (2) the strands of a first of said layers being in intimate contact with the outer surface of the fluid conducting member, and
  (3) the strands of each of the successive layers being in intimate contact with the strands in any adjacent layer on either side thereof at points of intersection with the strands of such adjacent layers,
  (4) the strands being arranged in such relative orientation with respect to each other as to form open passageways for the flow of fluid through the layers between the outer surface of the fluid conducting member and the ambient atmosphere around the thermal energy transfer apparatus;
  (5) the strands in each layer being permanently bonded to the strands in each adjacent layer at the areas of contact between the strands.

2. The apparatus as claimed in claim 1 wherein the strands of thermally conductive material extend around the fluid conducting member in a substantially helical pattern, with each successive layer of strands being inclined at a different angle from the strands of the previous layer so that the strands of each layer lie across the strands of the previous layer.

3. The apparatus as claimed in claim 1 wherein each of the strands of each layer are inclined at an opposite angle to the strands of any adjacent layer.

4. The apparatus as claimed in claim 1 wherein the strands are bonded together by welding.

5. The apparatus as claimed in claim 1 wherein each layer of strands has a first set of strands extending substantially circumferentially of the fluid conducting member and a second set of strands extending substantially longitudinally of the fluid conducting member.

6. The apparatus as claimed in claim 5 wherein each layer of strands comprises a mesh screen configuration.

7. The apparatus as claimed in claim 1 including a second hollow elongated member surrounding the outer layer of strands on the first mentioned hollow elongated fluid conducting member, said second hollow member being surrounded by a plurality of layers of spaced apart strands of thermally conductive material similar to the layers surrounding the first mentioned hollow elongated member, said layers of strands being secured to prevent them from becoming unwrapped.

8. The apparatus as claimed in claim 1 wherein the apparatus is enclosed within an elongated duct, the duct having an air intake means on at least one end of the duct and an air outlet means on at least one opposite end of the duct, whereby air can be injected in one end of the duct to f'-w along the thermal energy transfer means of the apparatus and thereby undergo a temperature change while flowing through the duct and thereafter be exhausted from the other end of the duct to change the temperature of the surrounding atmosphere outside the duct.

9. A thermal energy transfer apparatus comprising:

(A) a hollow elongated fluid conducting member having:

(1) an inlet end, (2) an outlet end, and (3) an outer surface surrounding the member, (B) thermal energy transfer means, surrounding at least a substantial portion of the outer surface of the fluid conducting member, for transferring thermal energy with respect to the fluid conducting member comprising;

(1) a first set of layers of spaced apart thermally conductive metal strands surrounding the fluid conducting member, with each layer in the first set lying at the same angle with respect to the fluid conducting member as the strands of any other layer of the first set, (2) a second set of layers of spaced apart thermally conductive metal strands surrounding the fluid conducting member with the strands of each layer in the second set lying at the same angle with respect to the fluid conducting member as the strands of any other layer of the second set, but at a different angle from the strands in the first set of layers, (3) the layers of one set alternately positioned between layers of the other set in such manner that the strands of each layer of the first set lie across the strands of at least one layer of the second set, (4) the strands of a radially innermost layer being in intimate contact with the outer surface of the fluid conducting member, and (5) the strands of each of the successive layers being in intimate contact with the strands in any adjacent layer on either side thereof, (6) the strands being arranged in such relative orientation with respect to each other as to form open passageways for the flow of fluid through the layers between the outer surface of the fluid conducting member and the ambient atmosphere around the thermal energy transfer apparatus;

(7) the strands in each layer being permanently bonded to the strands in each adjacent layer at the areas of contact between the strands.

10. The apparatus as claimed in claim 9 wherein the strands of thermally conductive material extend around the fluid conducting member in a substantially helical pattern, with each successive layer of strands being inclined at a different angle from the strands of the previous layer so that the strands of each layer lie across the strands of the previous layer.

11. The apparatus as claimed in claim 9 wherein each of the strands of each layer are inclined at an opposite angle to the strands of any adjacent layer.

12. The apparatus as claimed in claim 9 wherein the strands are bonded together by welding.

13. The apparatus as claimed in claim 9 wherein each layer of strands has a first set of strands extending substantially circumferentially of the fluid conducting member and a second set of strands extending substantially longitudinally of the fluid conducting member.

14. The apparatus as claimed in claim 9 wherein each layer of strands comprises a mesh screen configuration.

15. The apparatus as claimed in claim 9 including a second hollow elongated member surrounding the outer layer of strands on the first mentioned hollow elongated fluid conducting member, said second hollow member being surrounded by a plurality of layers of spaced apart strands of thermally conductive material similar to the layers surrounding the first mentioned hollow elongated member, said layers of strands being secured to prevent them from becoming unwrapped.

16. The apparatus as claimed in claim 9 wherein the apparatus is enclosed within an elongated duct, the duct having an air intake means on at least one end of the duct and an air outlet means on at least one end of the duct to flow along the thermal energy transfer means of the apparatus and thereby undergo a temperature change while flowing through the duct and thereafter be exhausted from the other end of the duct to change the temperature of the surrounding atmosphere outside the duct.

17. The apparatus as claimed in claim 9 wherein the strands in each layer of each set lie in substantial alignment with the strands of the other layers of the same set to define a series of planar fin members extending radially outwardly from the surface of the fluid conducting member.

18. The apparatus as claimed in claim 17 wherein the strands in each layer of each set are in intimate longitudinal contact at various spaced apart locations with the strands of the nearest layer of the same set on either side thereof.

19. A thermal energy transfer apparatus comprising:

(A) a hollow elongated fluid conducting member having:

(1) an inlet end, (2) an outlet end, and (3) an outer surface surrounding the member, (B) thermal energy transfer means, surrounding at least a substantial portion of the outer surface of the fluid conducting member, for transferring thermal energy with respect to the fluid conducting member comprising;

(1) a first set of layers of spaced apart thermally conductive metal strands surrounding the fluid conducting member, with each layer in the first set lying at the same angle with respect to the fluid conducting member as the strands of any other layer of the first set, (2) a second set of layers of spaced apart thermally conductive metal strands surrounding the fluid conducting member with the strands of each layer in the second set lying at the same angle with respect to the fluid conducting member as the strands of any other layer of the second set, but at a different angle from the strands in the first set of layers, (3) the layers of one set alternately positioned between layers of the other set in such manner that the strands of each layer of the first set lie across the strands of at least one layer of the second set, (4) the strands of a radially innermost layer being in intimate contact with the outer surface of the fluid conducting member, and (5) the strands of each of the successive layers being in intimate contact with the strands in any adjacent layer on either side thereof, at points of intersection with the strands of such adjacent layers, (6) the strands in each layer being permanently bonded to the strands in each adjacent layer at the areas of contact between the strands, (7) the strands being arranged in such relative orientation with respect to each other as to form open passageways for the flow of fluid through the lay s between the outer surface of the fluid conducting member and the ambient atmosphere around the thermal energy transfer apparatus.

* * * * *